US005914647A

United States Patent [19]

Aized et al.

[11] Patent Number: 5,914,647

[45] Date of Patent: Jun. 22, 1999

[54] SUPERCONDUCTING MAGNETIC COIL

[75] Inventors: Dawood Aized, Marlboro; Robert E. Schwall, Northborough, both of Mass.

[73] Assignee: American Superconductor Corporation, Westborough, Mass.

[21] Appl. No.: 08/615,532

[22] Filed: Mar. 12, 1996

Related U.S. Application Data

[60] Division of application No. 08/192,724, Feb. 7, 1994, Pat. No. 5,525,583, which is a continuation-in-part of application No. 08/186,328, Jan. 24, 1994, abandoned.

[51] Int. Cl.[6] ..... H01F 5/08

[52] U.S. Cl. ..... 335/216; 505/705; 505/211; 505/879

[58] Field of Search ..... 335/216; 336/DIG. 1; 505/705, 211, 879, 880

[56] References Cited

U.S. PATENT DOCUMENTS

| | | | |
|---|---|---|---|
| 3,440,585 | 4/1969 | Freeman, Jr. | 335/216 |
| 4,218,668 | 8/1980 | Tada et al. | 335/216 |
| 4,580,118 | 4/1986 | Kawamura | 335/216 |
| 4,983,574 | 1/1991 | Meyer | 505/1 |
| 5,247,271 | 9/1993 | Kawamura et al. | 335/216 |
| 5,310,705 | 5/1994 | Militsky et al. | 505/211 |
| 5,426,408 | 6/1995 | Jones et al. | 505/211 |
| 5,521,148 | 5/1996 | Torii et al. | 505/120 |

FOREIGN PATENT DOCUMENTS 61-082404 4/1986 Japan .

*Primary Examiner*—Michael L. Gellner
*Assistant Examiner*—Raymond Barrera
*Attorney, Agent, or Firm*—Fish & Richardson P.C.

[57] ABSTRACT

A superconducting magnetic coil includes a plurality of sections positioned axially along the longitudinal axis of the coil, each section being formed of an anisotropic high temperature superconductor material wound about a longitudinal axis of the coil and having an associated critical current value that is dependent on the orientation of the magnetic field of the coil. The cross section of the superconductor, or the type of superconductor material, at sections along the axial and radial axes of the coil are changed to provide an increased critical current at those regions where the magnetic field is oriented more perpendicularly to the conductor plane, to thereby increase the critical current at these regions and to maintain an overall higher critical current of the coil.

23 Claims, 12 Drawing Sheets

SUPERCONDUCTING MAGNETIC COIL

This is a divisional of application Ser. No. 08/192,724, filed Feb. 7, 1994, now U.S. Pat. No. 5,525,583, which is a continuation-in-part of Azied, entitled SUPERCONDUCTING MAGNETIC COIL, filed Jan. 24, 1994, Ser. No. 08/186,328, now abandoned.

STATEMENT AS TO FEDERALLY SPONSORED RESEARCH

This invention arose in part out of research pursuant to Subcontract No. 86X-SK700V awarded by the Department of Energy.

BACKGROUND OF THE INVENTION

The invention relates to superconducting magnetic coils and methods for manufacturing them.

As is known in the art, the most spectacular property of a superconductor is the disappearance of its electrical resistance when it is cooled below a critical temperature $T_c$. Another important property is the destruction of superconductivity by the application of a magnetic field equal to or greater than a critical field $H_c$. The value of $H_c$, for a given superconductor, is a function of the temperature, given approximately by $$H_c=H_o(1-T_c^2)$$

where $H_o$, the critical field at 0° K., is, in general, different for different superconductors. For applied magnetic fields less than $H_c$, the flux is excluded from the bulk of the superconducting sample, penetrating only to a small depth, known as the penetration depth, into the surface of the superconductor.

The existence of a critical field implies the existence of a critical transport electrical current, referred to more simply as the critical current ($I_c$) of the superconductor. The critical current is the current which establishes the point at which the material loses its superconductivity properties and reverts back to its normally conducting state.

Superconducting materials are generally classified as either low or high temperature superconductors operating below or at 4.2° K. and below or at 108° K., respectively. High temperature superconductors (HTS), such as those made from ceramic or metallic oxides are anisotropic, meaning that they generally conduct better in one direction than another. Moreover, it has been observed that, due to this anisotropic characteristic, the critical current varies as a function of the orientation of the magnetic field with respect to the crystallographic axes of the superconducting material. High temperature oxide superconductors include general Cu-O-based ceramic superconductors, members of the rare-earth-copper-oxide family (YBCO), the thallium-barium-calcium-copper-oxide family (TBCCO), the mercury-barium-calcium-copper-oxide family (HgBCCO), and BSCCO compounds containing stoichiometric amounts of lead (ie.,$(Bi,Pb)_2Sr_2Ca_2Cu_3O_{10}$).

High temperature superconductors may be used to fabricate superconducting magnetic coils such as solenoids, racetrack magnets, multipole magnets, etc., in which the superconductor is wound into the shape of a coil. When the temperature of the coil is sufficiently low that the conductor can exist in a superconducting state, the current carrying capacity as well as the magnitude of the magnetic field generated by the coil is significantly increased.

In fabricating such superconducting magnetic coils, the superconductor may be formed in the shape of a thin tape which allows the conductor to be bent around relatively small diameters and allows the winding density of the coil to be increased. The thin tape is fabricated as a multi-filament composite superconductor including individual superconducting filaments which extend the length of the multi-filament composite conductor and are surrounded by a matrix-forming material, which is typically silver or another noble metal. Although the matrix forming material conducts electricity, it is not superconducting. Together, the superconducting filaments and the matrix-forming material form the multi-filament composite conductor. In some applications, the superconducting filaments and the matrix-forming material are encased in an insulating layer. The ratio of superconducting material to matrix-forming material is known as the "fill factor" and is generally between 30 and 50%. When the anisotropic superconducting material is formed into a tape, the critical current is often lower when the orientation of an applied magnetic field is perpendicular to the wider surface of the tape, as opposed to when the field is parallel to this wider surface.

SUMMARY OF THE INVENTION

Controlling the geometry and/or type of anisotropic superconductor wound around a superconducting coil, increases an otherwise low critical current characteristic, associated with a region of the coil caused by the orientation of a magnetic field, thereby increasing the current carrying capacity and center magnetic field produced by the superconducting coil.

Generally, for a superconducting solenoid having a uniform distribution of high temperature superconductor wound along its axial length, the magnetic field lines emanating from the coil at its end regions become perpendicular with respect to the plane of the conductor (the conductor plane being parallel to the wide surface of the superconductor tape) causing the critical current density at these regions to drop significantly. In fact, the critical current reaches a minimum when the magnetic field is oriented perpendicularly with respect to the conductor plane. Although the critical current density is relatively high at the regions more central to the coil, the sharp decrease in the critical current density at the end regions provides an overall decrease in the current carrying capacity of the coil in its superconducting state.

Increasing the critical current value at the regions where the magnetic field is oriented more perpendicularly to the conductor plane can be provided in a number of ways. "Bundling" the amount of superconductor, by increasing the number of strands of the superconductor connected in parallel provides a greater cross section, thereby increasing the critical current at low $I_c$ regions. With this arrangement, the same type of superconductor, usually from the same superconductor tape manufacturing run, is used for the different sections of the coil. Varying the bundling of superconductor can be accomplished along the axis of the superconducting coil, for example, from one pancake section to the next, as well as within the pancake itself where the conductor cross-sectional area changes radially from the inner part to the outer part of the coil.

On the other hand, different superconductors having different fill factors may be used to distribute the amount of superconductor to control the critical current at the different sections of the coil. In still another arrangement, altogether different high temperature superconductors having different $I_c$ characteristics may be used for the different sections of the coil.

Because the magnetic field associated with a superconducting coil is directly related to the current carrying capacity of the coil, a concomitant increase in the magnetic field provided by the coil is also achieved. Even in applications where the volume of superconductor used for the coil is desired to be maintained substantially constant, and bundling of the superconductor requires that the number of turns associated with that section of the coil be reduced, the decrease in magnetic field at the regions of the coil associated with such sections does not significantly effect the magnitude of the magnetic field at the center region of the coil. Adjusting the geometry of the sections of the coil also provides, to some extent, a desired field distribution profile, while maintaining a higher critical current density of the coil.

Moreover, other problems commonly encountered with multi-sectioned uniform current density superconducting coils can be alleviated. For example, each section of a multi-sectioned uniform current density superconducting coil has an associated critical current value dependent on the orientation of the field incident on that section at any given time. In a uniform current density coil, where all of the sections are uniformly wound with the same amount of superconductor, certain sections (generally those at the end regions of the coil) will have critical current values significantly less than those positioned at the center of the coil. Unless the superconducting coil is operated at a critical current less than the lowest critical current value of the sections, the section with the lowest $I_C$ will operate in its normal non-superconducting state. In some situations, flawed sections of the superconductor, for example, during its manufacture, will have an $I_c$ value significantly lower than other sections of the superconductor. Current passing through a normally conducting section, generates $I^2R$ losses in the form of heat which propagates along the length of the superconductor to adjacent sections. Due to the heat generated in the normally conductive section, adjacent sections begin to warm causing them to become non-superconducting. This phenomena, known as "normal-zone propagation" causes the superconducting characteristic of these sections to degrade which leads to the loss of superconductivity for the entire coil, referred to as a "quench".

Because the critical current values associated with each of the individual sections (measured with respect to the orientation of the field incident on that section) of a graded superconducting coil, in accordance with the invention, have $I_c$ values closer to each other, the coil can be operated at a higher overall critical current. An additional advantage of maintaining a small difference between the critical current values of the individual sections of the superconducting coil is that a relatively quick transition to the overall critical current of the coil is obtained. Thus in the event that the coil reverts from the superconducting state to a normal state (quenches), the inductive energy stored in the coil is distributed uniformly throughout the coil rather than being localized where it might cause damage due to heating.

In one aspect of the invention, a magnetic coil features a plurality of sections positioned axially along a longitudinal axis of the coil, each section including a high temperature superconductor wound about the longitudinal axis of the coil, and having regions with critical current values, measured at a zero magnetic field, which increase in value from a central portion of the coil to end portions of the coil.

Particular embodiments of the invention include one or more of the following features. The critical current value of each section is dependent on the angular orientation of the magnetic field of the coil and is selected to provide a desired magnetic field profile for the coil. The critical current value of each section can be selected by varying the cross-sectional area of the superconductor of at least one section or by changing the type of superconductor of at least one section. The superconductor may be a mono-filament or a multi-filament composite superconductor including individual superconducting filaments which extend the length of the multi-filament composite conductor and are surrounded by a matrix-forming material. The number of individual superconducting filaments associated with a first one of the plurality of sections may be different than the number of individual superconducting filaments associated with a second one of the plurality of sections. The cross-sectional area of the superconductor is varied in a direction parallel to the longitudinal axis of the coil. and increases for the sections positioned at the central portion of the coil to the sections positioned at the end portions of the coil. The cross-sectional area of the superconductor is varied in a direction transverse to the longitudinal axis of the coil and decreases from regions proximate to the inner radial portion of the coil to the outer radial portion of the coil. The orientation of the individual tape-shaped superconducting filaments is other than parallel with respect to a conductor plane defined by a broad surface of the tape. The sections of the superconductor are formed of pancake or double pancake coils and the cross-sectional area of the superconductor is varied by increasing the number of strands of superconductor connected in parallel. The high temperature superconductor comprises $Bi_2Sr_2Ca_2Cu_3O$.

In another aspect of the invention, a superconducting magnetic coil features sections, positioned axially along a longitudinal axis of the coil, including a high temperature superconductor wound about the longitudinal axis of the coil, and each section having regions with critical current being substantially equal when a preselected operating current is provided through the superconducting coil.

In another aspect of the invention, a method for providing a superconducting magnetic coil including a plurality of sections positioned axially along the axis, with each section being formed of a preselected high temperature superconductor material wound about a longitudinal axis of the coil and having an associated critical current value, and each section contributing to the overall magnetic field of the coil, features the following steps:

a) positioning the sections along the axis of the coil to provide a substantially uniform distribution of superconductor material along the axis of the coil;

b) determining critical current data for each of the sections on the basis of the superconductor material associated with each section and the magnitude and angle of a magnetic field;

c) determining a distribution of magnetic field magnitude and direction values for a set of spaced-apart points within the magnetic coil;

d) determining critical current values for each of the points within the coil based on the distribution of magnetic field magnitude and direction values and the critical current data;

e) determining contributions toward the overall magnetic field of the coil from each of the sections;

f) determining a critical current value for the coil and for each section positioned along the axis of the coil; and g) changing the critical current value of at least one section of the coil to provide critical current values for each section substantially equivalent to each other.

In preferred embodiments, the method features one or more of the following additional steps. Steps c) through g)

are repeated until the critical current values of each of the sections based on the distribution are within a desired range of each other. The step of changing the critical current value of at least one section of the coil includes changing the type of superconductor or increasing the cross-sectional area of the superconductor material associated with sections of the superconductor that are axially or radially distant from the center of the coil for at least one section of the coil. The step of determining a critical current value for each section positioned along the axis of the coil includes the step of determining an average critical current value for each section, the average critical current value based on values of critical current associated with points extending either axially away or radially away from the center. The step of changing the critical current value of at least one section of the coil includes increasing the cross section of the superconductor material associated with sections of the superconductor that are away from the center of the coil. The step of determining critical current data for each of the sections of the coil further features the steps of measuring the critical current of the superconductor material associated with each section at a number of different magnitudes and angles of an applied background magnetic field, and extrapolating critical current data for unmeasured magnitudes and angles of a background magnetic field.

With this method, a superconducting coil having a predetermined volume of superconductor may have sections in which their geometries (for example, cross-sectional area) are changed along both the longitudinal and radial axes of the superconducting coil, thereby increasing the current carrying capacity and center magnetic field without increasing the volume of superconductor in the coil.

Other advantages and features will become apparent from the following description and the claims.

DESCRIPTION OF THE PREFERRED EMBODIMENT

Figure 1:
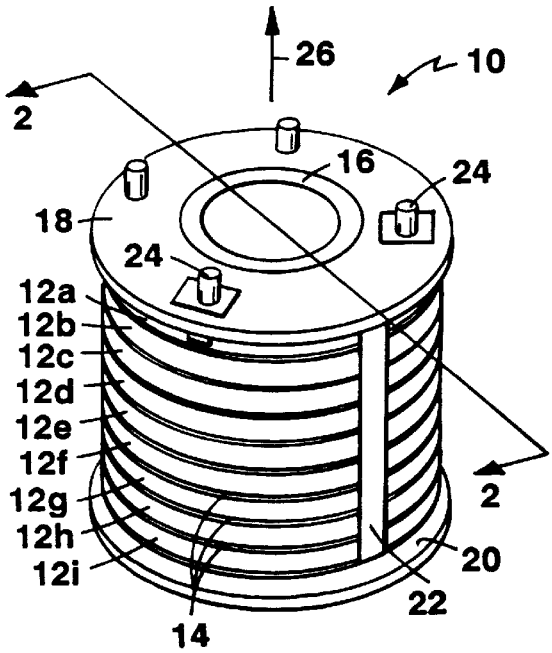
FIG. 1 is a perspective view of a multiply stacked superconducting coil having "pancake" coils.
Figure 2:
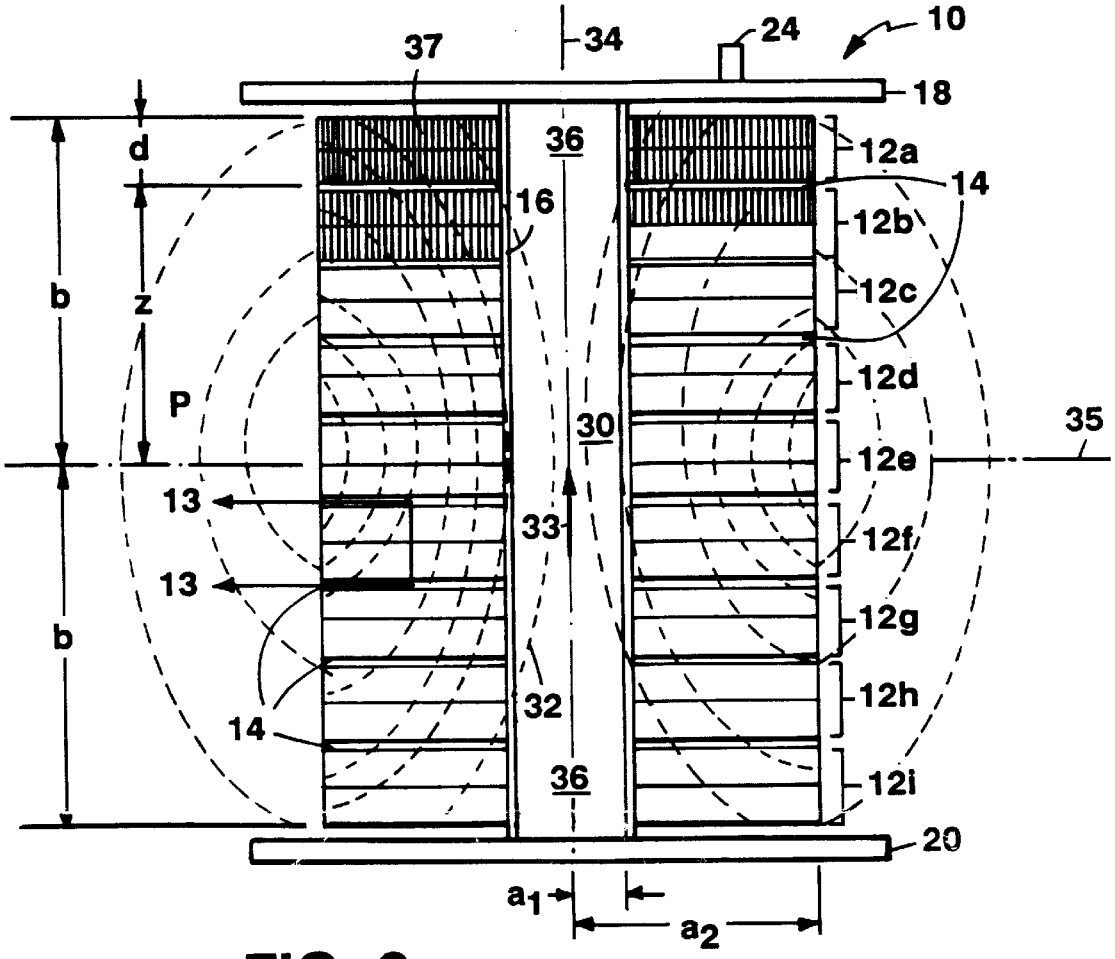
FIG. 2 is a cross-sectional view of FIG. 1 taken along line 2—2.

Referring to FIGS. 1–2, a mechanically robust, high-performance superconducting coil assembly 10 combines multiple double "pancake" coils 12*a*–12*i*, here nine separate pancake sections, each having co-wound composite conductors. The illustrated conductor is a high temperature metal oxide ceramic superconducting material known as $Bi_2Sr_2Ca_2Cu_3O$, commonly designated BSCCO (2223). In the coil assembly 10, each double "pancake" coil 12*a*–12*i* has co-wound conductors wound in parallel which are then stacked coaxially on top of each other, with adjacent coils separated by a layer of plastic insulation 14.

Pancake coils 12*a*–12*i* are formed by continuously wrapping the superconducting tape over itself, like tape on a tape recorder spool. An insulating tape of thin polyester film, sometimes with an adhesive, can be wound between the turns. Alternatively, the conductor can incorporate a film or oxide insulation applied before winding. Note that the superconductor may be completely processed to its final state prior to winding ("react and wind" coil) or may be exposed to a degree of heat treatment after the pancakes have been wound ("wind and react" coil), the method influencing the insulation system chosen. In one embodiment, the completed pancakes are then stacked and connected in series by bridging pieces of conductive tape soldered between stacks. Plastic insulation 14, formed as disc-shaped spacers are suitably perforated to permit the free circulation of refrigerant and are usually inserted between the pancakes during stacking. Pancake coils 12*a*–12*i* here are constructed as "double-pancake" coils with the tape appearing to be wound from the outside to the inside of the first pancake and then wound from the inside to the outside of the second pancake, thereby eliminating the soldered bridge between the two pancakes which would otherwise occur at the inner diameter of the coil.

An inner support tube 16 fabricated from a plastic-like material supports the coils 12*a*–12*i*. A first end flange 18 is attached to the top of inner support tube 16, with a second end flange 20 threaded onto the opposite end of the inner support tube in order to compress the double "pancake" coils. In an alternate embodiment, inner support tube 16 and end flanges 18, 20 can be removed to form a free-standing coil assembly.

Electrical connections consisting of short lengths of superconducting material (not shown) are made to join the individual coils together in a series circuit. A length of superconducting material 22 also connects one end of coil 10 to one of the termination posts 24 located on end flange 18 in order to supply current to coil assembly 10. The current is assumed to flow in a counter-clockwise direction, and the magnetic field vector 26 is generally normal to end flange 18 forming the top of coil assembly 10.

Referring to FIGS. 2, the superconducting magnetic coil 10, has a magnetic field characteristic similar to a conventional solenoid in which the magnetic field intensity at points outside the coil (for example, point P) is generally less than at points internal to the coil. For conventional magnetic coils, the current carrying capacity is substantially constant throughout the windings of the conductor. On the other hand, with low temperature superconductors, the critical current is dependent only on the magnitude of the magnetic field and not its direction.

Further, as discussed above, the current carrying capacity of a high temperature superconductor is not only a function of the magnitude but the angular orientation of the magnitude field. In a central region 30 of the coil, the magnetic field lines 32 are generally parallel (indicated by an arrow 33) with the longitudinal axis 34 of the coil and become less so as the magnetic field lines extend away from a central region 30 and towards end regions 36 of coil 10. Indeed, the orientation of field lines 32 at end regions 36 (indicated by an arrow 37) become substantially perpendicular with respect to axis 34.

Figure 3:
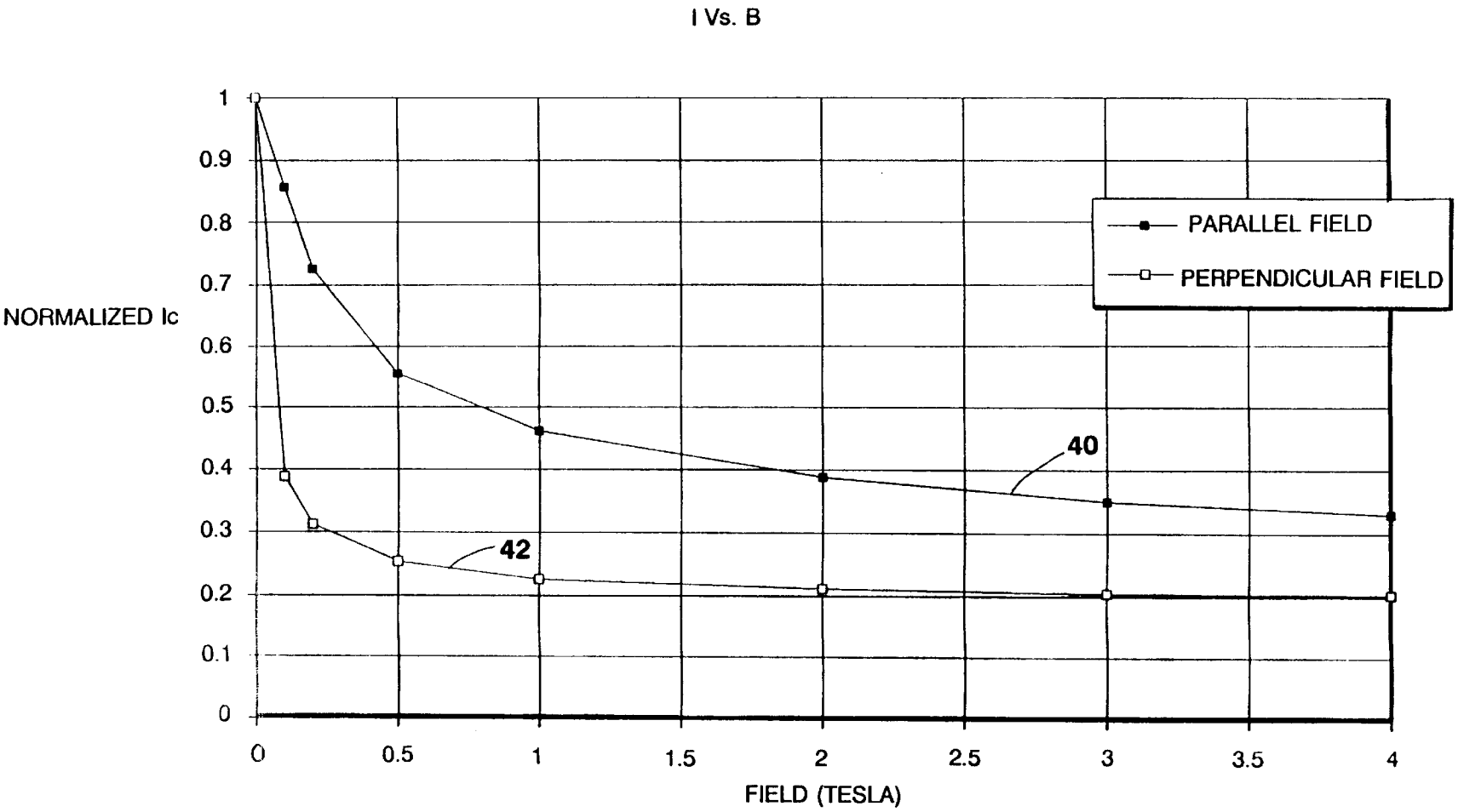
FIG. 3 is a graph showing normalized critical current as a function of magnetic field in units of Tesla.

Referring to FIG. 3, the anisotropic characteristic of critical current as a function of magnetic field for BSCCO (2223) high temperature superconductor is shown for applied magnetic fields oriented parallel (line 40) and perpendicularly (line 42) to the conductor plane. The actual critical current values have been normalized to the value of critical current of the superconductor measured at a zero magnetic field. Normalized critical current is often referred to as the critical current retention. As shown in FIG. 3, the normalized critical current, at a magnetic field of 2.0 T (tesla), drops significantly from about 0.38 for a parallel oriented magnetic field to 0.22 for a perpendicularly oriented magnetic field.

In addition to being dependent on the magnitude and orientation of the magnetic field, the critical current of a high temperature superconductor varies with the particular type of superconductor as well as its cross-sectional area. Thus, in order to compensate for the drop in critical current of the superconductor at end regions 36 of coil 10 due to the magnetic field becoming more perpendicular with respect to the conductor plane, those pancakes positioned at the end regions (for example, 12*a,* 12*b,* 12*g,* 12*h*) may be fabricated with a superconductor having a higher critical current characteristic, or alternatively, may be formed to have a greater cross-sectional area of superconductor relative to those regions more central to the coil.

Figure 4:
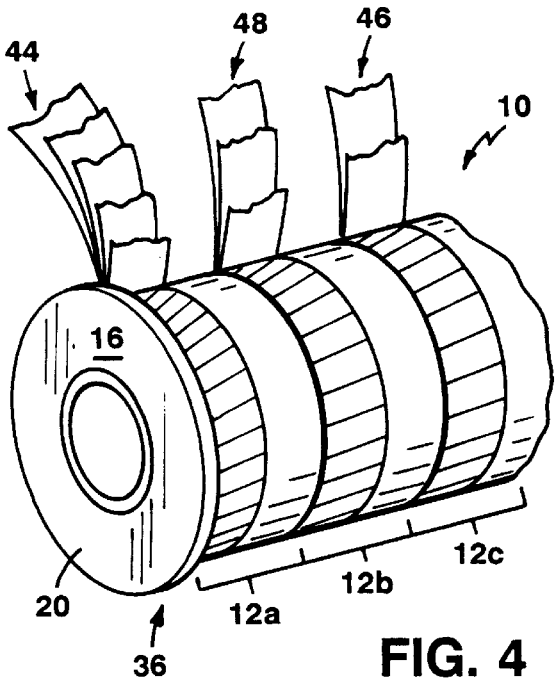
FIG. 4 is a view of the coil showing the conductors partially peeled-away.
Figure 14:
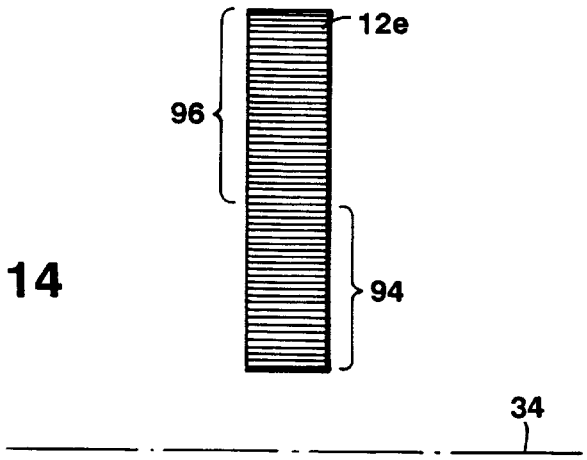
FIG. 14 is a cross-sectional view of an exemplary one of the pancakes of FIGS. 1 and 2.

For example, referring to FIG. 4, a graded superconducting coil assembly 10 is shown with one side of the three endmost double pancakes 12*a,* 12*b,* and 12*c,* peeled away to show that an increased amount of superconductor tape is used for the double pancakes positioned axially furthest from the central region 30 of the coil. In particular, pancake 12*a* includes five wraps of conductor tape 44 between wraps of insulating tape as compared to only two wraps of conductor tape 46 for pancake 12*c* located more closely to the center region 30. Pancake 12*b,* positioned between pancakes 12*a* and 12*c,* includes three wraps of conductor tape 48 to provide a gradual increase of superconductor to compensate for the gradual decrease in the critical current, due to the generated magnetic field, when moving from pancake 12*c* to pancake 12*a*. As will be discussed below, in conjunction with FIGS. 13 and 14, the cross-sectional area of superconductor can be varied along the radial axis of the coil during its fabrication.

Figure 5:
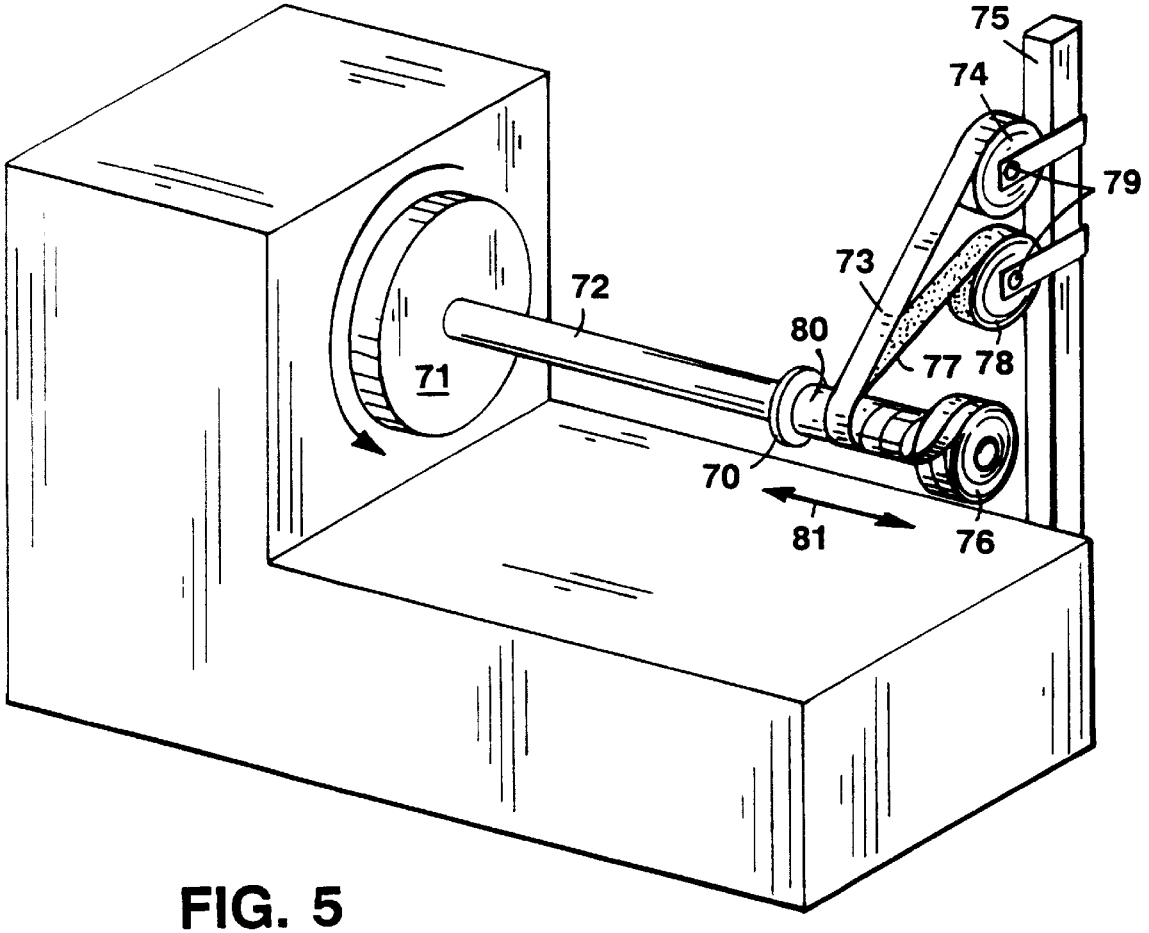
FIG. 5 illustrates a coil-winding device.

Referring to FIG. 5, in one approach for fabricating a superconducting coil, a mandrel 70 is held in place by a winding flange 72 mounted in a lathe chuck 71, which can be rotated at various angular speeds by a device such as a lathe or rotary motor. The multi-filament composite conductor is formed in the shape of a tape 73 and is initially wrapped around a conductor spool 74. In a react-and-wind process for fabricating a superconducting coil, the conductor is a precursor material which is fabricated and placed in a linear geometry, or wrapped loosely around a coil, and placed in a furnace for processing. The precursor is then placed in an oxidizing environment during processing, which is necessary for conversion to the superconducting state. In the react-and-wind processing method, insulation can be applied after the composite conductor is processed, and material issues such as the oxygen permeability and thermal decomposition of the insulating layer do not need to be addressed. On the other hand, in a wind-and-react processing method, the precursor to the superconducting material is wound around a mandrel in order to form a coil, and then processed with high temperatures and an oxidizing environment. Details related to the fabrication of superconducting coils are discussed in co-pending application Ser. No. 08/188,220, filed on Jan. 28, 1994, filed by M. D. Manlief, G. N. Riley, Jr., J. Voccio, and A. J. Rodenbush, entitled "Superconducting Composite Wind-and-React Coils and Methods of Manufacture", assigned to the assignee of the present invention, and attached herewith as Appendix I.

In the wind-and-react processing method, a cloth 77 comprising an insulating material is wrapped around an insulation spool 78, both of which are mounted on an arm 75. The tension of the tape 73 and the cloth 77 are set by adjusting the tension brakes 79 to the desired settings. A typical value for the tensional force is between 1–5 lbs., although the amount can be adjusted for coils requiring different winding densities. The coil forming procedure is accomplished by guiding the eventual conducting and insulating materials onto the rotating material forming the central axis of the coil. Additional storage spools 76 are also mounted on the winding shaft 72 in order to store portions of the tape 73 intended to be wound after the initial portions of materials stored on spool 74 on the arm 75 have been wound onto the mandrel.

In order to form a coil 80, the mandrel 70 is placed on the winding shaft 72 next to storage spools 76 and the devices are rotated in a clockwise or counter-clockwise direction by the lathe chuck 71. In certain preferred embodiments of the invention, a "pancake" coil is formed by co-winding layers of the tape 73 and the cloth 77 onto the rotating mandrel 70. Subsequent layers of the tape 73 and cloth 77 are then co-wound directly on top of the preceding layers, forming a "pancake" coil having a height 81 equal the width of the tape 73. The "pancake" coil allows both edges of the entire length of tape to be exposed to the oxidizing environment during the heat treating step.

In other preferred embodiments of the invention, a double "pancake" coil may be formed by first mounting the mandrel 70 on the winding shaft 72 which is mounted in lathe chuck 71. A storage spool 76 is mounted on the winding shaft 72, and half of the total length of the tape 73 initially wrapped around spool 74 is wound onto the storage spool 76, resulting in the length of tape 73 being shared between the two spools. The spool 74 mounted to the arm 75 contains the first half of the length of tape 73, and the storage spool 76 containing the second half of the tape 73 is secured so that it does not rotate relative to mandrel 70. The cloth 77 wound on the insulation spool 78 is then mounted on the arm 75. The mandrel is then rotated, and the cloth 77 is co-wound onto the mandrel 70 with the first half of the tape 73 to form a single "pancake" coil. Thermocouple wire is wrapped around the first "pancake" coil in order to secure it to the mandrel. The winding shaft 72 is then removed from the lathe chuck 71, and the storage spool 76 containing the second half of the length of tape 73 is mounted on arm 75.

A layer of insulating material is then placed against the first "pancake" coil, and the second half of the tape 73 and the cloth 77 are then co-wound on the mandrel 70 using the process described above. This results in the formation of a second "pancake" coil adjacent to the "pancake" coil formed initially, with a layer of insulating material separating the two coils. Thermocouple wire is then wrapped around the second "pancake" coil to support the coil structure during the final heat treatment. Voltage taps and thermo-couple wire can be attached at various points on the tape 73 of the double "pancake" coil in order to monitor the temperature and electrical behavior of the coil. In addition, all coils can be impregnated with epoxy after heat treating in order to improve insulation properties and hold the various layers firmly in place. The double "pancake" coil allows one edge of the entire length of tape to be exposed directly to the oxidizing environment during the final heat treating step.

Figure 6:
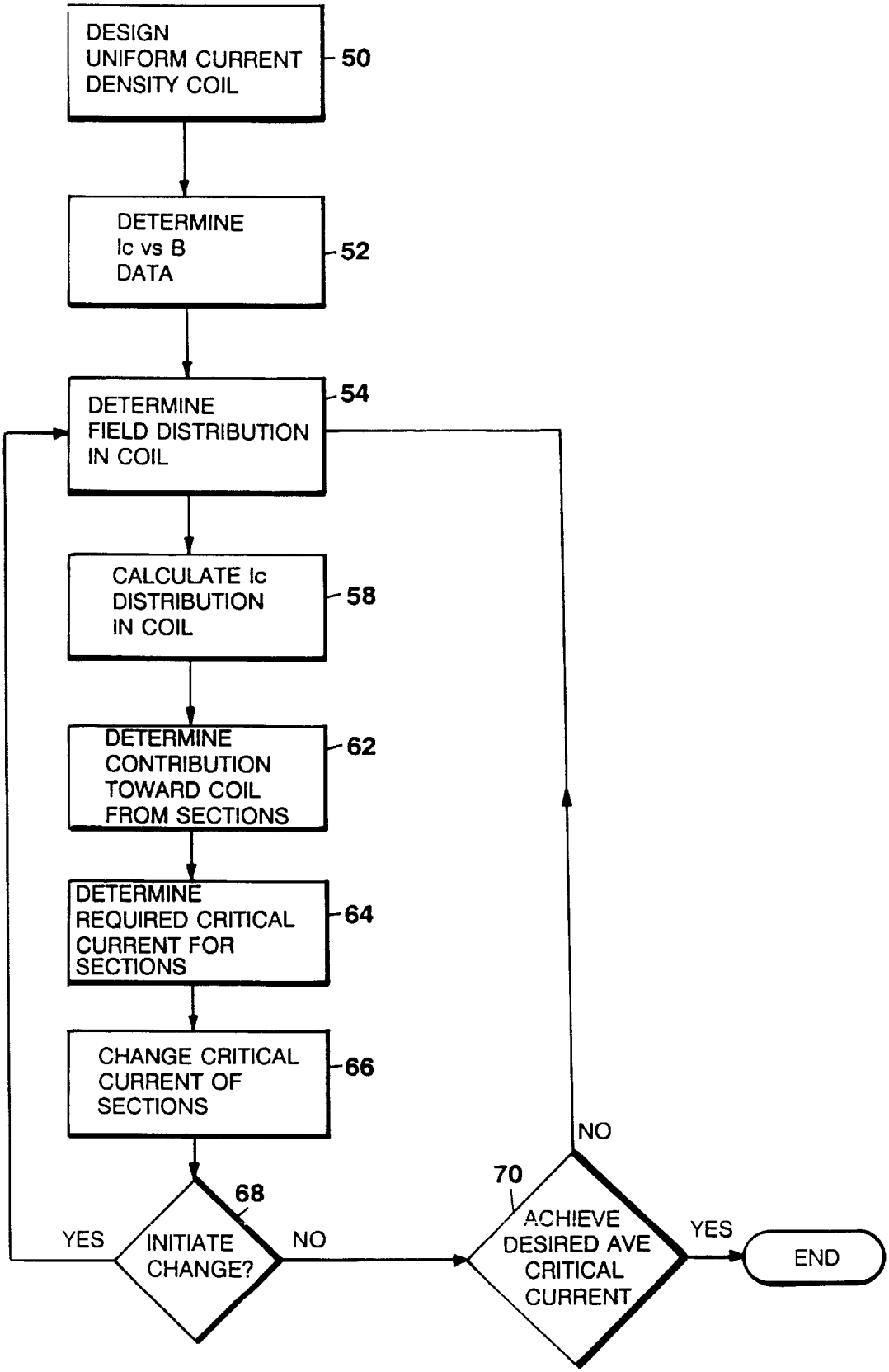
FIG. 6 is a flow diagram describing the method of making the superconducting coil of the invention.

An explanation of a method for providing a graded superconducting coil follows in conjunction with FIG. 6. A graded superconducting magnetic coil similar to the one shown in FIGS. 1 and 2 and having the characteristics shown below in Table I, is used to illustrate the method.

TABLE I

| | | |
|---|---|---|
| Winding inner diameter (ID) | = | 1.00 inch |
| Winding outer diameter (OD) | = | 3.50 inches |
| Coil length (L) | = | 4.05 inches |
| Number of double pancakes | = | 9 |
| Number of turns/double pancake | = | 180 |
| Conductor tape width | = | .210 inches |
| Conductors tape thickness | = | .006 inches |
| Critical current of the wire | = | 82 A (4.2° K. at 0 Tesla) |
| Target center field | = | 1 Tesla |

Referring to FIG. 6, in accordance with a particular embodiment of the invention, a first step 50 in designing a graded superconducting coil is the design of a uniform current density (non-graded) coil in which the conductor is evenly distributed along the axial length of the coil. The design of such a coil can be determined as described, for example, in D. Bruce Montgomery, *Solenoid Magnet Design,* pp 1–14 (Robert E. Krieger Publishing Company 1969), which is hereby incorporated by reference. Taking into account certain geometrical constraints (for example, the size of the cryostat for providing the low temperature environment), current densities of the selected high temperature superconductor and the desired magnetic field required from the coil, the following relationship can be used to determine the required geometry of the coil:

$$j = \frac{H_{cen}}{a_1 \lambda F(\alpha, \beta)} \tag{1}$$

where:

$H_{cen}$ is the field at the center of the coil;

$\lambda$ (the winding density of the coil) equals the active section of the winding divided by the total winding section; and F is a geometric constant defined as:

$$F = \frac{4\pi\beta}{10}\left(\mathrm{Sinh}^{-1}\frac{\alpha}{\beta} - \mathrm{Sinh}^{-1}\frac{1}{\beta}\right) \tag{2}$$

where $$\alpha = \frac{a_2}{a_1} \text{ and } \beta = \frac{b}{a_1}$$

where $a_1$ and $a_2$ are the inner and outer radii of the coil and b is one half of the total axial length of the coil (see FIG. 2).

To determine the critical current of the coil and its sections, it is necessary to know the critical current characteristic of the particular high temperature superconductor(s) used in the coil. This information (step 52) is often provided not only for the particular superconductor material, but because of changes in the manufacturing process, is generally provided for each manufacturing run of the superconductor. In one approach for providing $I_c$ as a function of magnetic field (B), as shown in FIG. 3, a current is applied to a length of the superconductor at a desired operating temperature, here 4.2° K., while monitoring the voltage across the length of superconductor. The current is increased until the superconductor resistivity approaches a certain value, thereby providing the critical current value at that field. The method of determining critical current for superconductors is described in D. Aized et al, *Comparing the Accuracy of Critical-Current Measurements Using the Voltage-Current Simulator,* Magnet Technology Conference (MT-13), to be published, and attached herewith as Appendix II. An external magnet is used to provide a background magnetic field to the superconductor at various magnetic field intensities and orientations. FIG. 3, as discussed above, shows measured values of the critical current as a function of this applied magnetic field for a background magnetic field oriented both parallel and perpendicular to the conductor plane.

Although it is desirable to characterize each superconductor at as many different field intensities and angles of orientation as possible, it is appreciated that such data collection can be voluminous and time consuming, and thus extrapolation methods can be used to expand data measured at a limited number of points. Thus, where measured data at different angles is not available, data measured with the magnetic field applied parallel and perpendicular to the conductor plane can be used with approximation models to generate critical current values for fields applied at different angles.

In one approximation model, called the minimum retention model, the critical current of the conductor is determined for both parallel and perpendicular field components with the lower value of critical current taken as the critical current at the point under consideration.

In another approximation model, called the gaussian distribution model, the effect of the orientation of individual filaments of superconductor with respect to the plane of the tape (that is, the conductor plane) is considered. When the superconductor is formed as a multi-filament composite superconductor, as discussed above, the superconducting filaments and the matrix-forming material are encased in an insulating ceramic layer to form the multi-filament composite conductor. Although the individual filaments are generally parallel to the plane of the composite conductor tape, some of the filaments may be offset from parallel and therefore have a perpendicular field component associated with them. The gaussian distribution model assumes that the orientation of the individual superconducting filaments with respect to the conductor plane follow a Gaussian distribution. The characteristic variance is varied to match the critical current data measured in step 52 and once the variance is found, it can be used to determine the critical current at any given field and angle.

In still another model, called the superimposing model, a normalized critical current is determined for both the perpendicular and parallel components of the magnetic field and then the product taken of the two values.

Curve-fitting based on the measured data can be advantageously used to derive a polynomial expression which provides a critical current value for any magnetic field intensity and orientation angle. The following polynomial expression having the constants as shown in Table II was used to generate the curves shown in FIG. 3:

$$I_c(B)=1/(a_0+a_1B+a_2B^2+a_3B^3+a_4B^4+a_5B^5+a_6B^6)$$

TABLE II

| Constants | Parallel Field Data | Perpendicular Field Data |
|---|---|---|
| $a_0$ | 0.995 | 1.032 |
| $a_1$ | 1.650 | 18.550 |
| $a_2$ | 1.096 | −45.140 |
| $a_3$ | −3.335 | 51.967 |
| $a_4$ | 2.344 | −28.481 |
| $a_5$ | −0.659 | 7.817 |
| $a_6$ | 0.0649 | −0.669 |

Results from the minimum retention and gaussian distribution models were generally found to be similar and provided a better match to the measured data than the superimposing model with the minimum retention model preferred due to its ease of implementation.

Once a database of critical current as a function of magnetic field has been obtained for each superconductor material to be used in the graded superconducting coil, the magnetic field distribution for a predetermined number of points (for example, 1000 points) within the coil is determined (step 54). The field calculations for determining the field distribution within the coil is dependent on the geometry of the coil (for example, inner and outer diameter, length of coil), the characteristics of the superconductor (for example, conductor width and thickness for tape, conductor radius for wire), as well as, the insulation thickness, and relative position of individual sections of the coil. A software program called MAG, (an in-house program used at American Superconductor Corporation, Westboro, Mass.), provided the total magnetic field, as well as the radial and axial components, as a function of radial and axial position within the superconducting coil. Table III shows a small representative portion of the output data provided by MAG for the coil having the geometry and characteristics described above.

TABLE III

| | Radial | Axial | Component of Field | | |
|---|---|---|---|---|---|
| Position | Position | Position | $B_r$ (Rad) | $B_a$ (Axi) | B (tot) |
| 1 | 0 | 0 | 4.82E-16 | 1.73E-02 | 1.73E-02 |
| 2 | 0 | 0.12 | −9.70E-17 | 1.73E-02 | 1.73E-02 |
| 3 | 0 | 0.24 | 2.24E-16 | 1.73E-02 | 1.73E-02 |
| 4 | 0 | 0.36 | 1.26E-16 | 1.73E-02 | 1.73E-02 |
| 5 | 0 | 0.48 | 2.55E-16 | 1.73E-02 | 1.73E-02 |
| . | . | . | . | . | . |
| . | . | . | . | . | . |
| . | . | . | . | . | . |
| 14 | 0 | 1.56 | −7.80E-17 | 1.68E-02 | 1.68E-02 |

TABLE III-continued

| | Radial | Axial | Component of Field | | |
|---|---|---|---|---|---|
| Position | Position | Position | $B_r$ (Rad) | $B_a$ (Axi) | B (tot) |
| 15 | 0 | 1.68 | 1.16E-15 | 1.68E-02 | 1.68E-02 |
| 16 | 0 | 1.80 | 9.69E-16 | 1.67E-02 | 1.67E-02 |
| 17 | 0 | 1.92 | −8.95E-16 | 1.66E-02 | 1.66E-02 |

Commercially available software, such as ANSYS, a product of Swanson Analysis Systems Inc., Houston, Penna., or COSMOS, a product of Structural Research and Analysis Group, Santa Monica, Calif., may also be used to generate the field distribution information.

Figure 7:
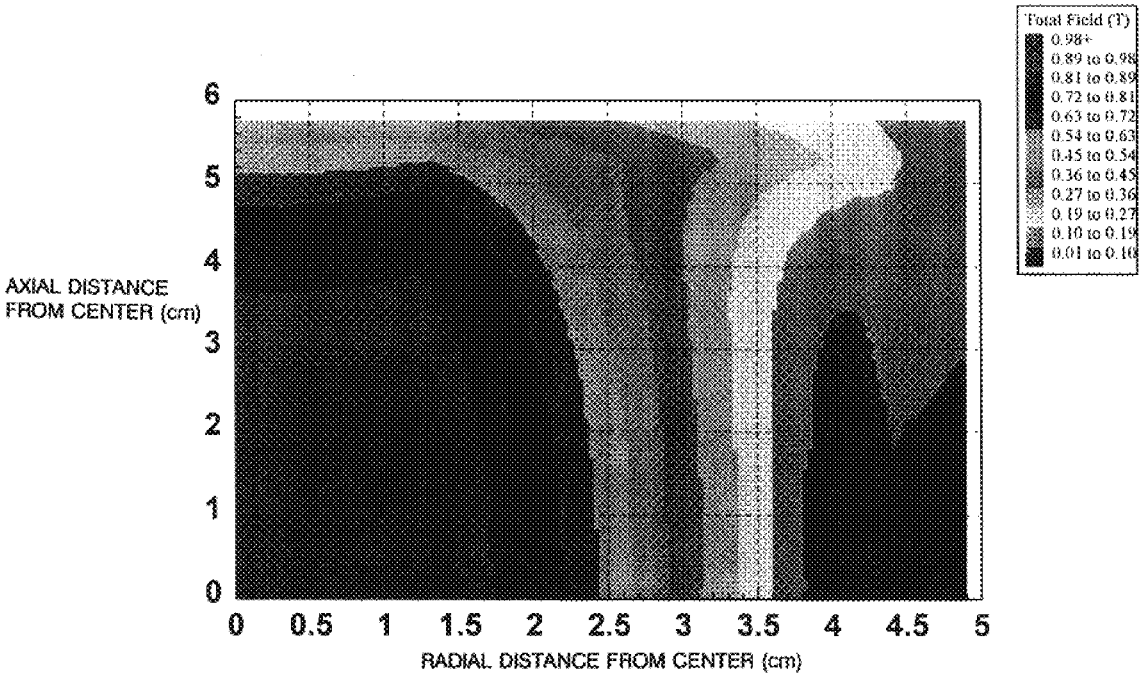
FIG. 7 is a plot showing the total magnetic field distribution within a superconducting coil having a uniform current distribution.
Figure 8:
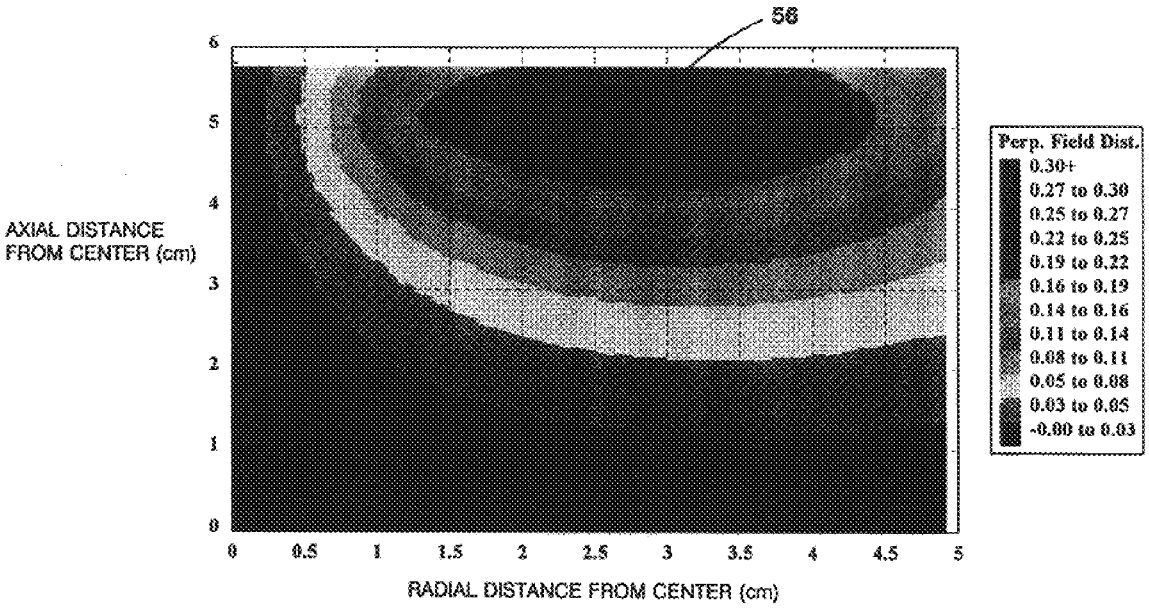
FIG. 8 is a plot showing the distribution of a magnetic field oriented perpendicularly to the conductor plane within the uniform current density superconducting coil.

Referring to FIG. 7, the total field distribution data for the coil defined in Table I is shown plotted in graphical form using any number of commercially available software programs, such as Stanford Graphics, a product of 3-D Visions, Torrance, Calif. In addition, as shown in FIG. 8, the magnetic field for the same coil when the field is oriented perpendicularly to the conductor plane is maximum at point 56, near the end regions of the coil (about 5.2 cm from the center along the longitudinal axis of the coil) and a little more than half of the radial distance to the outer diameter of the coil (about 2.7 cm).

Figure 9:
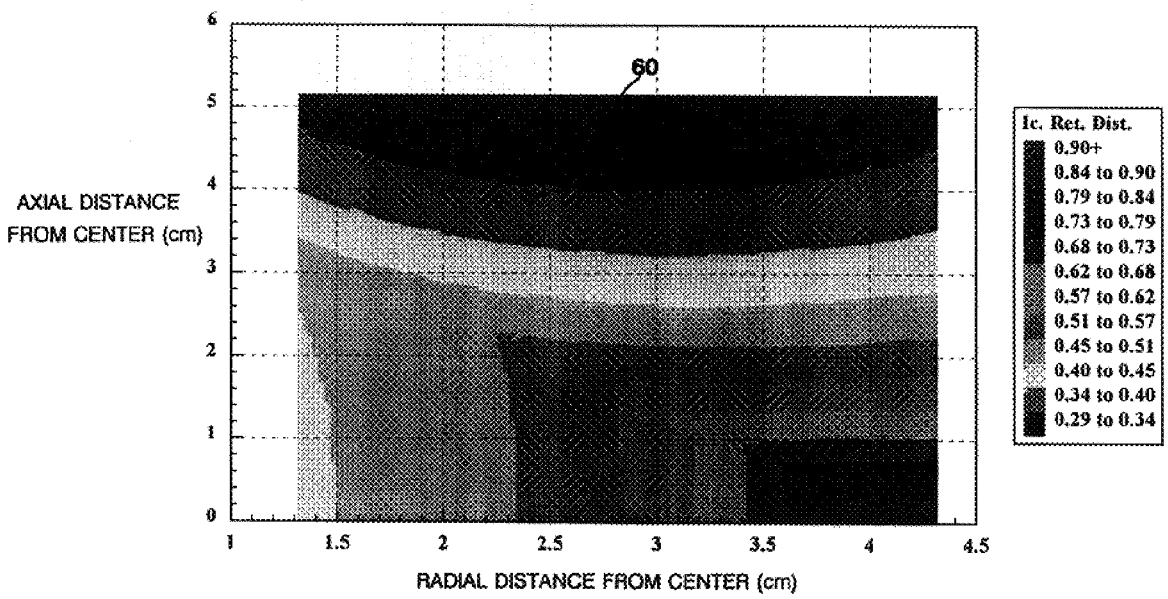
FIG. 9 is a plot showing the normalized critical current distribution within the uniform current density superconducting coil.

The field distribution data generated in step 54 provides a magnetic field value at each of the predetermined number of points within the coil which can be used in conjunction with the $I_c$ versus B data provided in step 52 to derive a critical current distribution within the coil (step 58). In other words, the magnetic field values from the field distribution data are used in the polynomial expression described above to determine critical current values for each point. In particular, critical current values are determined for both the parallel field and perpendicular field orientations with the minimum value used to represent the critical current value for that point. The $I_c$ distribution data is shown plotted in FIG. 9 and indicates that, consistent with the field distribution data of FIG. 8, the minimum critical current retention values (that is, normalized critical current) is found in shaded region 60 at end regions of the coil.

The next step of the method involves determining the contributions of each of the sections of coil 10, that is pancakes 12*a*–12*i*, toward the center magnetic field of the coil step 62. Contributions from each pancake 12*a*–12*i* are determined using the relationships described above in conjunction with determining the field distribution of the uniform density coil (step 54). To determine each contribution, the coil is assumed to be symmetrical about the mid-plane through axis 35 (FIG. 2) with pancakes on either side of midplane 35 being symmetrically paired (for example, 12*a* and 12*i*, 12*b* and 12*h*, 12*c* and 12*g*, etc.). The contribution of each pair of sections is then determined, using the field relationships described above, by 1) determining or evaluating the total field generated by a coil having a length defined by the outermost length of the paired sections of interest, 2) determining or evaluating the total field generated by a coil having a length defined by the innermost length of the paired sections of interest, and then 3) subtracting the results of the two determinations or evaluations. Each of the paired sections can then be divided by one-half to determine the contribution for each pancake of the pair of sections. For example, referring to FIG. 2 again, to determine the contribution of paired pancakes 12*a* and 12*i*, the field determined for a coil having length 2*z* is subtracted from the field of a coil having length 2*b*. The contribution toward the center field from each of pancakes 12*a* and 12*i* is then one-half of the contribution of the symmetric pair. Similarly, to determine the contribution of pancakes 12*b* and 12*h,* the field determined for a coil having length 2(*b*–*d*) or 2*z* is subtracted from a coil having a length 2(*b*–2*d*). [Note that the inner and outer radii $a_1$ and $a_2$ are the same for all calculations.] The total field generated by the whole assembly of the coil is the sum of all the contributions from the different pancakes.

The $I_c$ distribution data generated in step 58 is then used to optimize the distribution of superconductor for different regions of the coil. For a superconducting coil in which double pancake coils 12*a*–12*i* are used (like the one shown in FIGS. 1 and 2) each position corresponds with an associated one of the individual pancakes and the $I_c$ value for positions along the longitudinal axis of the coil is determined (step 64).

In one approach, called the critical current averaging approach, a weighted average of all $I_c$ values extending radially within the region for each axial position or pancake, is determined using the following relationship:

$$I_c\mathrm{Ave}(z) = \frac{\left(\sum I_c \times \mathrm{radius}\right)}{\left(\sum \mathrm{radii}\right)}.$$

Thus, for a given axial position of the coil, the average of all the critical current values corresponding to that axial position in that region is provided with the radius of each point being the averaging weight for that point. In addition, the average critical current value for each radial position in the region associated with each section, with equal weight given for each point, is determined using the following relationship:

$$I_cAve(r)=\Sigma I_c/(\text{number of points}).$$

Figure 10:
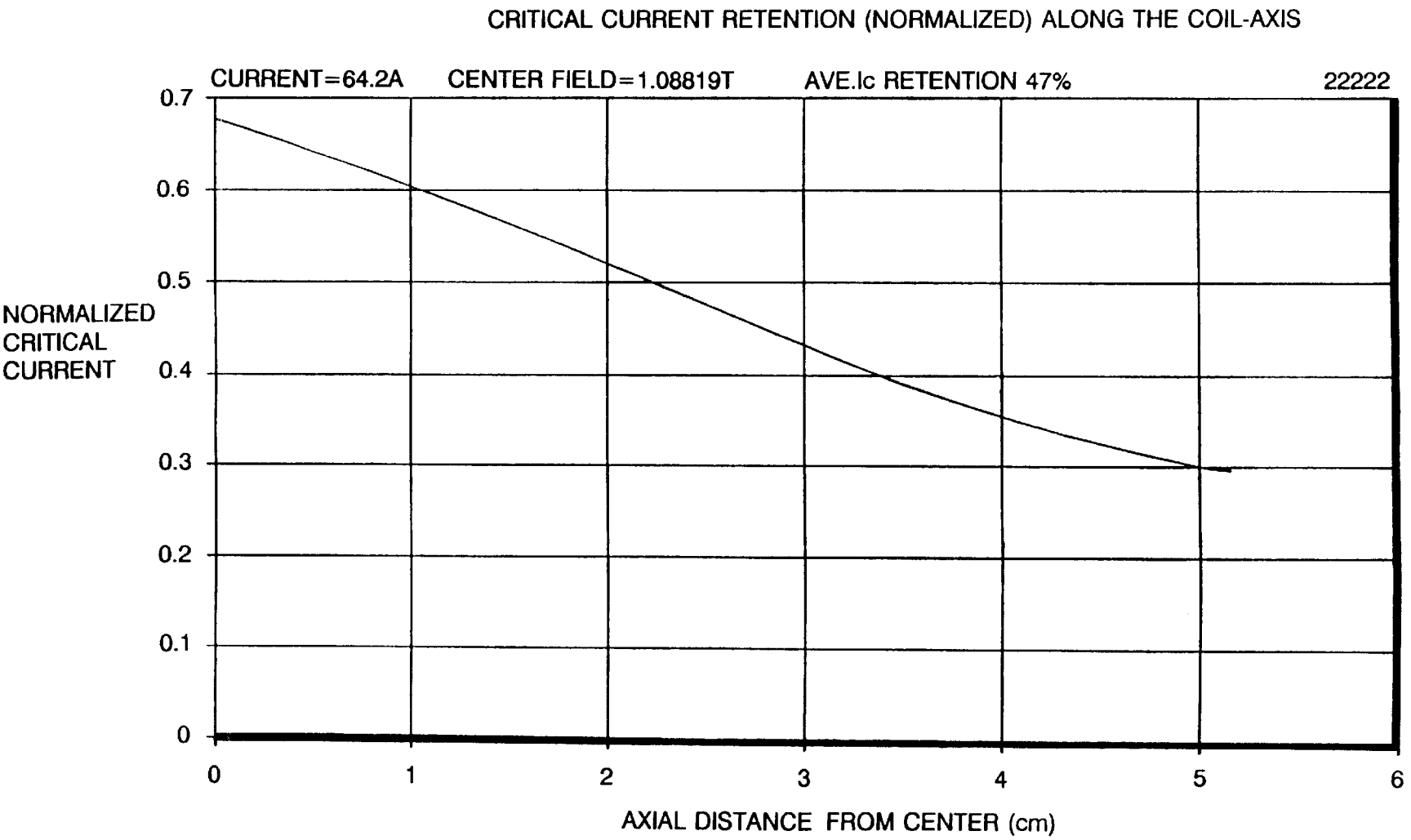
FIG. 10 is a graph showing the average normalized critical current distribution as a function of the axial length of the uniform current density superconducting coil.

FIG. 10 shows the average $I_c$ for the superconducting coil of Table I having a uniform current distribution as a function of the axial distance from the center of the coil. By estimating the average critical current for the different sections of a uniform current distribution coil, and noting their relative differences, a determination can be made as to what degree of change in the cross-sectional area of the conductor or type of superconductor is needed to increase the critical current values for sections having low critical current values, so that the critical current values of all the sections of the coil are relatively close in value to the critical current value associated with sections at the center of the coil.

As indicated in FIG. 10, the superconducting coil with the geometry described above in Table I, has an average normalized $I_c$ of approximately 0.68 (that is 68% of the critical current at zero field) for the region associated closest to the center of coil 10 and associated with pancake 12*e.* However, at the regions axially positioned approximately four centimeters from the center of coil (in the vicinity of pancakes 12*a* and 12*i*), the average normalized $I_c$ drops to about 0.35, approximately one-half that associated with pancake 12*e.* Thus, increasing the cross-sectional area of superconductor for pancakes 12*a* and 12*i* by an order of two would provide critical current values closer in value.

For example, in one embodiment, the cross section is increased at regions of the coil by bundling two conductors at center pancake 12*e* and pancakes 12*d* and 12*f,* three conductors for 12*b,* 12*c,* 12*g,* 12*h,* and four conductors for pancakes 12*a* and 12*h* at the ends of coil 10 to provide a gradual increase in the cross section of superconductor from the center region 30 to the end regions 36 of the graded superconducting coil. As shown in FIG. 4, in one embodiment, bundling of the superconductor can be achieved by increasing the number of overlaying wraps of the conductor tape between wraps of insulating tape.

In addition, the average $I_c$ for the entire coil is determined by averaging the $I_c$ over the individual pancakes and taking the length of the conductor used in that section as the averaging weight, expressed numerically as:

$$I_c(\text{coil ave}) = \frac{\sum (I_c \text{ of the pancake}) \times (\text{conductor length for the section})}{\text{total conductor length of the coil}}$$

Figure 11:
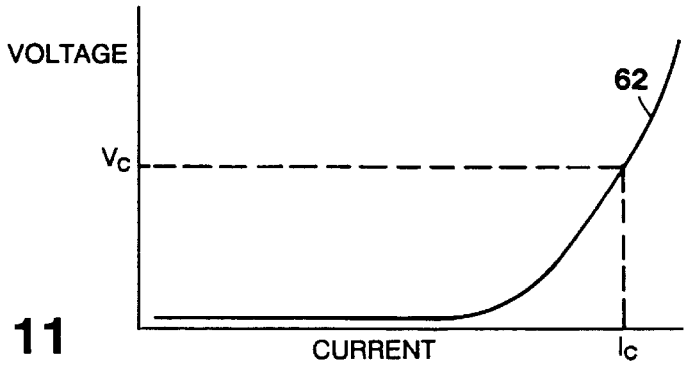
FIG. 11 is a graph showing the voltage-current characteristic of a superconducting coil.

Alternatively, a critical current value which more accurately represents the value of the critical current of the entire coil can be provided by determining critical voltage values (v) for different regions of the coil based on the following relationship:

$$(v/v_c)=(i/i_c)^n$$

where $i_c$ is the critical current at that region;

$v_c$ is the critical current criterion which is dependent on the geometry of the conductor in that region;

and n is the index value as described in detail in Aized's article, *Comparing the Accuracy of Critical-Current Measurements Using the Voltage-Current Simulator,* referenced above and included as an appendix to this specification. Voltages (v) for each region are determined for each current level (i) and summed to provide a total voltage $V_T$ for that current level. Total voltages $V_T$ are then plotted as a function of current (line 62) and the above relationship is used to determine a total critical current criterion $V_c$ for the coil. This plotted function, as shown in FIG. 11, is then used to provide the critical current $I_c$ of the entire coil that is associated with $V_c$.

In another approach for optimizing the distribution of superconductor for different regions of the coil, referred to as the "minimum $I_c$" approach, the $I_c$ values for positions throughout the coil are determined on the basis of a minimum critical current value positioned closely to the center of the coil. In this approach, the coil is partitioned into a large number of small regions each having an associated minimum $I_c$ value. The region closest to the center of the coil, both axially and radially, establishes a reference level for grading the remaining regions of the coil.

Figure 12:
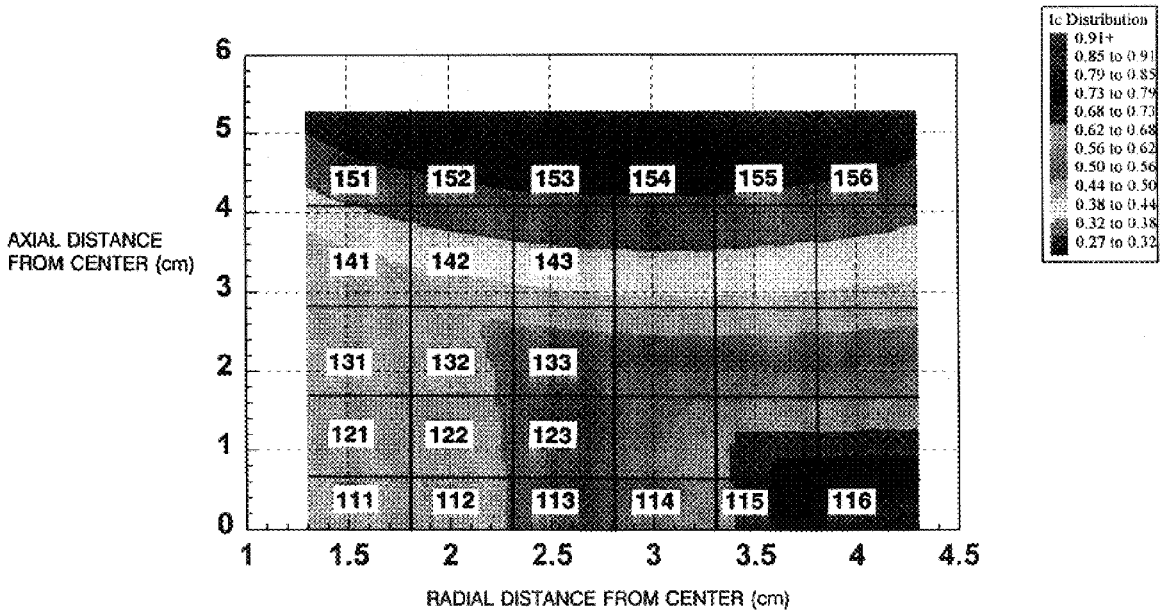
FIG. 12 is a plot showing the critical current distribution divided among regions for a superconducting coil.

For example, referring to FIG. 12, the same superconducting coil analyzed above in conjunction with FIG. 10, includes a region 111, positioned most closely, both axially and radially, to the center of the coil that includes a point within region 111 having a minimum normalized $I_c$ value of 0.44 (that is 44% of the critical current at zero field). This minimum normalized $I_c$ value establishes a reference to which all other minimum normalized values of the remaining regions are referenced. Thus, if the section of the coil associated with region 111 includes two bundles of superconductor (like pancake 12*c* in FIG. 4), regions 151–156, which are at the end regions of the coil and having minimum normalized $I_c$ values of 0.27, the degree of change needed to increase the critical current values for regions 151–156 so that they are close in value to the critical current value associated with the section closest to region 111 is about a three and one-third times the superconductor used at region 111 [(44/27)*(2)=3.3]. In this situation, regions 151–156 may either be wound with three superconductor bundles having a proportionally higher $I_c$ retention value or with four superconductor bundles having a proportionally lower $I_c$ retention value.

The minimum critical current at central region approach is generally considered to be a more conservative approach for determining the optimum distribution of conductor as compared to the critical current averaging approach because of its reliance on a minimum and not an average of critical current values. Thus, the minimum $I_c$ at central region approach is generally more suitable in the design of high performance superconducting magnets which are more likely to be operated very near the minimum critical current value of any part of the superconductor and are therefore, more susceptible to normal zone propagation.

Using the minimum $I_c$ at central region approach for the coil as defined in Table I resulted in a decrease in the G/A (gauss/ampere) rating of the entire coil from 172 G/A for a uniform current distribution coil (that is, a 22222 superconductor distribution) to 162 G/A for a graded coil having a 22234 superconductor distribution. This is due to the decrease in winding turns associated with low critical current sections and is not representative of the magnitude of the magnetic field at the center of the coil which is usually increased. Furthermore, the theoretical $I_c$ required to generate the desired one Tesla field at the center of the coil also decreased significantly from 215 A=(10000/(172*0.27) to 140.3 A=(10000/(172*0.44).

By using either the "critical current averaging" or "minimum $I_c$" approaches, the cross-sectional area of the conductor for each of the pancakes can be changed to provide a higher average $I_c$ value for the coil and to provide $I_c$ values for all of the individual pancakes that are close in value (step 66). This objective can also be accomplished by changing the type of superconductor for each pancake proportionally to provide retention $I_c$ value closer to the maximum $I_c$ value.

Because the cross-sectional area or type of superconductor associated with the sections of the coil may be changed to increase the critical current at the regions of the coil in which that section is located, it is generally necessary to repeat steps 54–66 for the newly configured coil. Changing the distribution of conductor for the sections of the superconducting coil, requires that the field and critical current distributions, as well as field contributions of each of the sections of the new coil be redetermined (step 68). This is necessary because the change in the cross-sectional area or type of superconductor associated with each section changes the field characteristics associated with that section, as well as the entire coil. For example, because it is generally desirable that the volume of the superconducting coil be substantially maintained, increasing the cross section of the superconductor for a section of the coil will generally decrease the number of turns or windings in that section, thereby changing the magnetic field characteristics and the contribution toward the center field of the coil. However, because this change generally occurs at the end regions of the coil, where the critical current is lower (due to the substantially perpendicular orientation of the magnetic field), the lower magnetic field (due to the decrease in turns) does not significantly contribute to the magnitude of the center magnetic field. In other words, although there is generally a decrease in the magnitude of the magnetic field at the end regions of the coil, there is a relatively significant increase in the critical current and current carrying capacity of the coil.

The cross-sectional area of the superconductor or type of superconductor for each pancake, and thus their respective critical current values, can be iteratively adjusted until a desired average $I_c$ for the entire coil is achieved (that is, the $I_c$ when all the sections of the coil have nearly same $I_c$) (step 70). Statistical analysis can be used to calculate the standard deviation for the coil sections and to minimize its value by adjusting the number of conductors in the different sections of the coil. It is important to note that providing a greater number of superconductor bundles at center region 30 of coil 10 provides a greater number of bundles which can be used for sections of the coil intermediate center region 30 and end regions 36, and thus a smoother grading of the coil.

Figure 13:
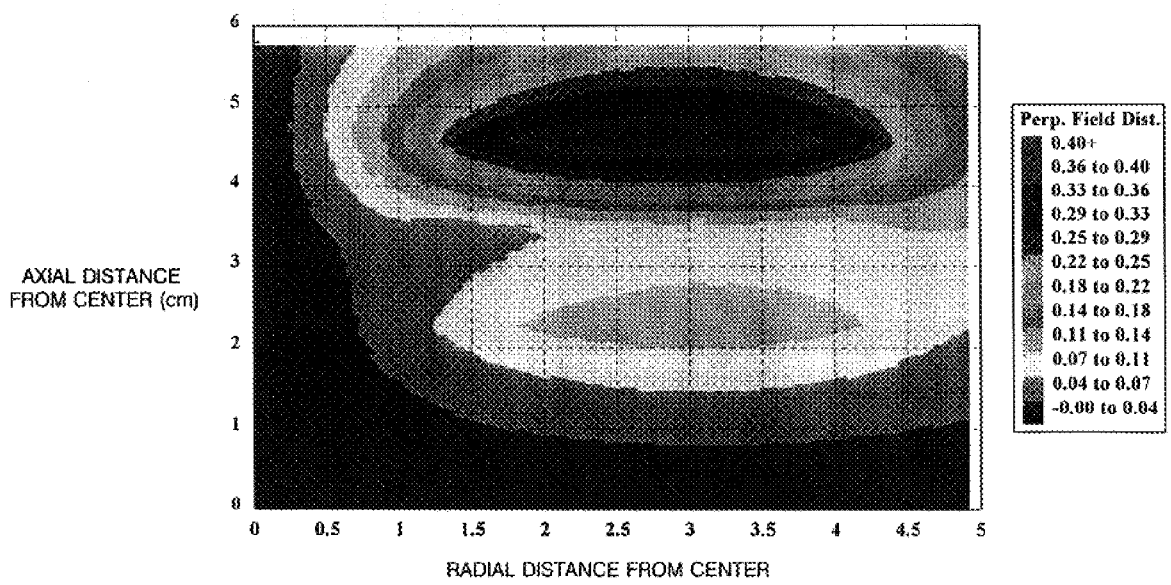
FIG. 13 is a plot showing the magnetic field distribution within a non-optimum superconducting coil having a non-uniform current distribution.

For the superconducting coil having the geometry described in Table I, the cross sections of pancakes 12*a*–12*i* were changed by varying the number of layers of superconductor as shown in FIG. 4 to provide a superconducting coil having an increased average critical current value, and hence an increase in the current carrying capacity and magnetic field for the coil. Table IV summarizes results after each iteration for the coil with the configuration arrangement (first column) describing the number of layers of conductor. For example, 22222 defines a uniform current density coil (that is, each pancake having one layer of conductor) while 22334 describes a configuration where the three inner-most pancakes 12*d*–12*f* have two layers, pancakes 12*b*, 12*c*, 12*g*, and 12*h* have three layers, while outermost layers 12*a* and 12*i* have four layers. This configuration (22334) was selected as having the most optimal arrangement because it provided a small variation ($I_c$ standard deviation=9.26) in the critical current over the coil volume while providing a large average $I_c$ (89.41A) and high magnetic field (1.357 T). Although, configuration 22344 also provided a relatively low standard deviation and higher average $I_c$ and magnetic field, the field distribution provided by this configuration, as shown in FIG. 13, provided multiple areas (called "depressions") where the magnetic field intensity achieves a maxima for a field oriented perpendicularly to the conductor plane. Configurations having such field distributions degrade the overall performance of the superconducting coil.

TABLE IV

| Configuration | G/A | Ave.Ic(A) | Field(T) | $I_c$Std.dev.(A) |
|---|---|---|---|---|
| 22222 | 172.80 | 63.23 | 1.142 | 17.09 (25.8%) |
| 22223 | 169.34 | 71.50 | 1.211 | 12.45 (17.4%) |
| 22233 | 163.77 | 77.75 | 1.273 | 9.51 (12.2%) |
| 22234 | 161.99 | 81.28 | 1.316 | 10.59 (13.0%) |
| 22334 | 151.87 | 89.41 | 1.357 | 9.26 (10.3%) |
| 22344 | 148.80 | 94.12 | 1.400 | 13.58 (14.4%) |

It is also important to note that the geometry of the different sections of the coil can also be varied along the radial axis of the coil, as opposed to along the longitudinal axis, as described above. For example, referring to FIG. 14, a cross-sectional view of a portion (one-half of one side) of an exemplary one of the double pancakes 12*a*–12*i* of FIGS. 1 and 2, shows that the number of bundled conductors 90 need not be the same throughout the pancake. In fact, in much the same way as the cross-sectional area of superconductor was varied along the longitudinal axis of the coil the cross-sectional area of the superconductor, can be varied along the radial axis of each section or pancake of the coil. For example, as is shown in FIG. 7, the total magnetic field for the uniform distribution coil decreases from the inner to the outer radius of the coil. Thus, it is desirable to decrease the cross-sectional area at this region of the pancake, thereby allowing an increase in the number of turns of conductor, which increases the central magnetic field of the coil.

Figure 15:
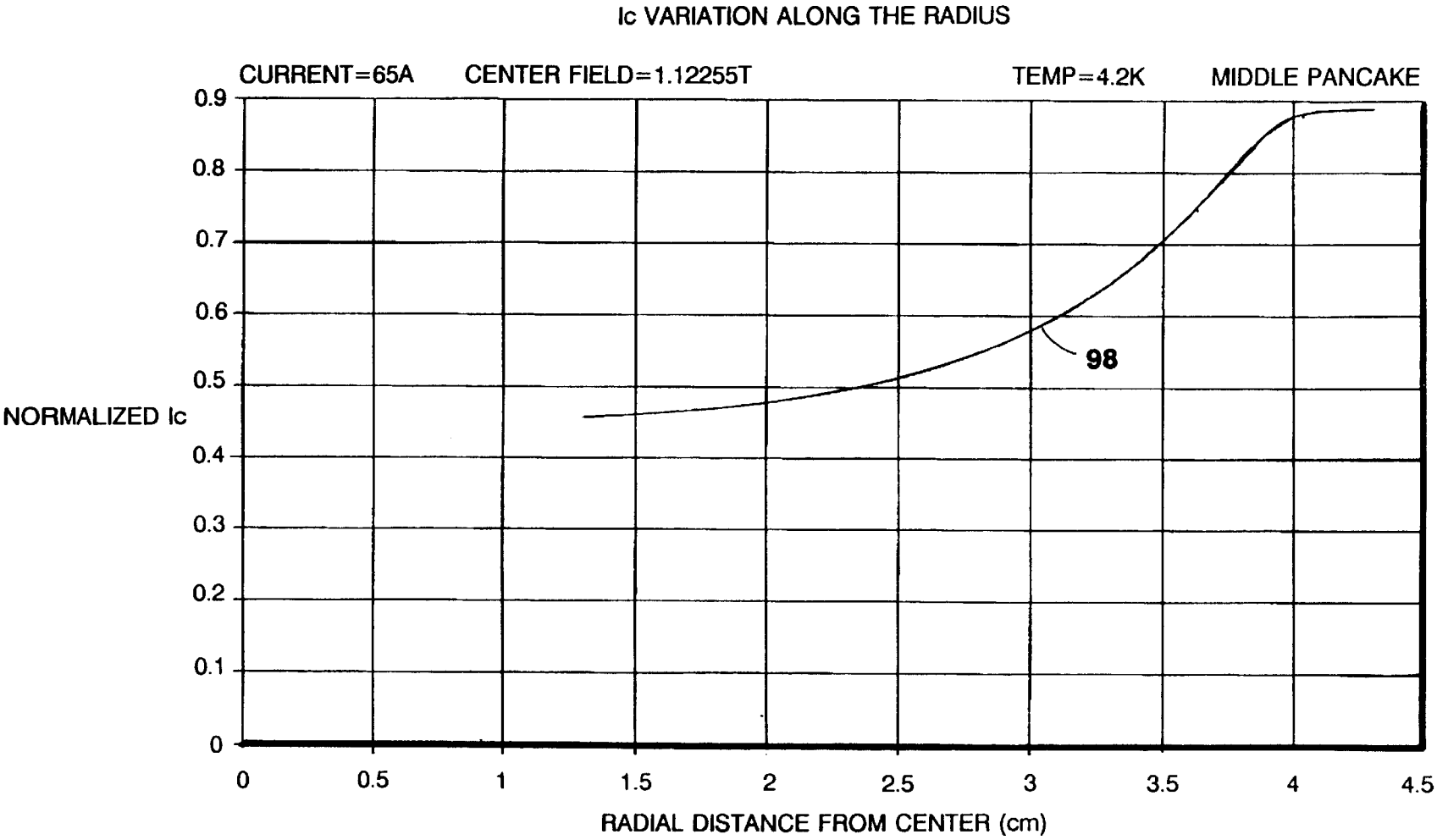
FIG. 15 is a graph showing the average normalized critical current distribution as a function of the radius of the uniform current density superconducting coil.

Using a critical current averaging approach, a weighted average of all $I_c$ values extending axially within the region for each radial position of the pancake is determined in much the same way as was described above in conjunction with averaging for each axial position of the coil. Referring to FIG. 15, the average normalized $I_c$ (line 98) for the middle pancake 12*e* of the superconducting coil of Table I having a uniform current distribution can be plotted as a function of the radial distance from the center of the coil. Note that the inner radius of the pancake is about 1.3 cm from the center of the coil. A determination can then be made as to what degree of change in the cross-sectional area of the conductor is needed to increase the critical current values for regions having low critical current values within the coil by observing the relative difference in average critical current between the different sections of the uniform current distribution coil. Similarly, the critical current distribution data, as shown in FIG. 12, indicates regions along the radial axis of the coil having low $I_c$ values which should be increased when the "minimum critical current" approach is used.

Thus, either the "critical current averaging" or "minimum $I_c$" approaches, described above, can be used to change the cross-sectional area of superconductor within each of the pancakes to provide a higher average $I_c$ value for the coil and to provide $I_c$ values for all of the individual pancakes that are substantially equivalent.

In general, the $I_c$ increases from the center to the outer windings of the coil and, therefore, it is generally desirable to provide superconductor of greater cross-sectional area at the regions closer to the center (that is, internal windings) than at regions radially outward. For example, referring again to FIG. 14, if three conductors are bundled at portion 94 (associated with, for example, regions 111–113), only two conductors would be required at portion 96 (associated with outermost radial regions 114–116) of the coil. During the fabrication of one embodiment of a pancake coil, the three conductors are wound around the coil until the radial distance at which it is desired to reduce the number of conductors is reached. At this point, one of the conductors is cut leaving an end which is attached, for example, by soldering, to an adjacent one of the remaining conductors, and winding of the coil is continued. By decreasing the number of conductors of a coil at regions where the critical current has a sufficiently high value allows a greater number of turns to be wound on the coil at these regions, thereby increasing the magnetic field provided by the coil.

What is claimed is:

1. A magnetic coil comprising sections positioned axially along a longitudinal axis of the magnetic coil, each section including a pancake coil comprising a high temperature superconductor wound about the longitudinal axis of the magnetic coil, each section having regions with critical current values, measured at a zero magnetic field, increasing in value from a central portion of the magnetic coil to end portions of the magnetic coil, the critical current value of each region being dependent on the angular orientation of a magnetic field of the magnetic coil.

2. The magnetic coil of claim 1 wherein the critical current value of each region is dependent on the type of superconductor.

3. The magnetic coil of claim 1 wherein the critical current values of the regions of the sections decrease in value from an inner radial portion of the magnetic coil, proximate to the longitudinal axis of the magnetic coil, to an outer radial portion of the magnetic coil.

4. The magnetic coil of claim 1 wherein the critical current values of the regions are varied by varying the cross-sectional area of the superconductor of the regions of each section.

5. The magnetic coil of claim 4 wherein the superconductor is formed as a superconductor tape comprising a multi-filament composite superconductor including individual superconducting filaments which extend the length of the multi-filament composite conductor and are surrounded by a matrix-forming material.

6. The magnetic coil of claim 5 wherein the cross-sectional area of the superconductor of the regions is varied in a direction parallel to the longitudinal axis of the magnetic coil.

7. The magnetic coil of claim 6 wherein the cross-sectional area of the superconductor increases for the sections positioned at the central portion of the magnetic coil to the sections positioned at the end portions of the magnetic coil.

8. The magnetic coil of claim 5 wherein the cross-sectional area of the superconductor of the regions is varied in a direction transverse to the longitudinal axis of the magnetic coil.

9. The magnetic coil of claim 5 wherein a number of individual superconducting filaments associated with a first one of the plurality of sections is different than a number of individual superconducting filaments associated with a second one of the plurality of sections.

10. The magnetic coil of claim 5 wherein the orientation of the individual superconducting filaments is other than parallel with respect to a conductor plane defined by a broad surface of the tape.

11. The magnetic coil of claim 4 wherein the cross-sectional area of the superconductor is varied by increasing the number of strands of superconductor in parallel.

12. The magnetic coil of claim 1 wherein the critical current value of each region is selected by changing the type of superconductor of at least one section.

13. The magnetic coil of claim 1 wherein the sections of the superconductor are formed of double pancake coils.

14. The magnetic coil of claim 1 wherein the critical current values of the regions of each section are varied to provide a desired magnetic field profile for the magnetic coil.

15. The magnetic coil of claim 1 wherein the high temperature superconductor comprises $Bi_2Sr_2Ca_2Cu_3O$.

16. A magnetic coil comprising sections positioned axially along a longitudinal axis of the coil, each section including a high temperature superconductor wound about the longitudinal axis of the coil and formed as a superconductor tape comprising a multi-filament composite superconductor including individual superconducting filaments which extend the length of the multi-filament composite conductor and are surrounded by a matrix-forming material, each section having regions with critical current values, measured at a zero magnetic field, increasing in value from a central portion of the coil to end portions of the coil wherein the cross-sectional area of the superconductor for each section decreases from regions proximate to the inner radial portion of the coil to the outer radial portion of the coil and the critical current values of the regions are varied by varying the cross-sectional area of the superconductor of the regions of each section.

17. A magnetic coil comprising sections positioned axially along a longitudinal axis of the coil, each section including a high temperature superconductor wound about the longitudinal axis of the coil, each section having a critical current value, the critical current values being substantially equal when a preselected operating current is provided through the superconducting coil.

18. A magnetic coil comprising sections positioned axially along a longitudinal axis of the coil, each section including a high temperature bulk superconductor material wound about the longitudinal axis of the coil, each section having regions with critical current values, measured at a zero magnetic field, increasing in value from a central portion of the coil to end portions of the coil, and wherein the critical current values of the regions of the sections decrease in value from an inner radial portion of the coil, proximate to the longitudinal axis of the coil, to an outer radial portion of the coil.

19. The magnetic coil of claim 18 wherein the bulk superconductor material is in tape form.

20. The magnetic coil of claim 18 wherein the critical current values of the regions are varied by varying the cross-sectional area of the superconductor of the regions of each section.

21. The magnetic coil of claim 18 wherein the critical current value of each region is selected by changing the type of superconductor of at least one section.

22. The magnetic coil of claim 18 wherein the superconductor is formed as a superconductor tape comprising a multi-filament composite superconductor including individual superconducting filaments which extend the length of the multi-filament composite conductor and are surrounded by a matrix-forming material.

23. The magnetic coil of claim 22 wherein a number of individual superconducting filaments associated with a first one of the plurality of sections is different than a number of individual superconducting filaments associated with a second one of the plurality of sections.

* * * * *